United States Patent [19]

Stuiber et al.

[11] 4,134,694

[45] Jan. 16, 1979

[54] DUAL PITCH TABULAR STOP ASSEMBLY

[75] Inventors: Walter Stuiber, Karben; Karl Wenderoth, Bad Vilbel, both of Fed. Rep. of Germany

[73] Assignee: Adlerwerke vorm. Heinrich Kleyer A.G., Nuremberg, Fed. Rep. of Germany

[21] Appl. No.: 782,248

[22] Filed: Mar. 28, 1977

[30] Foreign Application Priority Data

Apr. 29, 1976 [DE] Fed. Rep. of Germany ..... 2618875

[51] Int. Cl.[2] ..... B41J 21/04

[52] U.S. Cl. ..... 400/293; 400/296.1; 400/298

[58] Field of Search ..... 197/70, 176, 177, 178, 197/179

[56] References Cited

U.S. PATENT DOCUMENTS

| | | | |
|---|---|---|---|
| 720,302 | 2/1903 | Webb | 197/178 |
| 874,059 | 12/1907 | Fisher | 197/178 |
| 1,082,033 | 12/1913 | Lockwood | 197/179 |
| 1,508,911 | 9/1924 | Aichele | 197/70 |
| 3,333,669 | 8/1967 | Schaefer | 197/179 X |
| 3,346,091 | 10/1967 | Cralle et al. | 197/179 X |
| 3,540,565 | 11/1970 | Hanft et al. | 197/70 X |
| 3,858,706 | 1/1975 | Gottsmann | 197/176 |
| 4,031,994 | 6/1977 | Schaefer | 197/70 |

OTHER PUBLICATIONS

IBM Technical Disclosure Bulletin, "Dual-Pitch Tab Rack," Kruspe, vol. 8, No. 5, Oct. 1965, p. 793.

*Primary Examiner*—Ernest T. Wright, Jr.
*Attorney, Agent, or Firm*—Joseph R. Spalla

[57] ABSTRACT

A tabular stop assembly having two sets of uniformly spaced tab stops for use with a typewriter with a dual pitch escapement wherein individual stops of each set are formed on each of an array of uniformly spaced C-shaped tabs which are mounted for rotative movement relative to a tab rack to first and second set positions corresponding to a selected escapement pitch.

3 Claims, 5 Drawing Figures

Fig_1
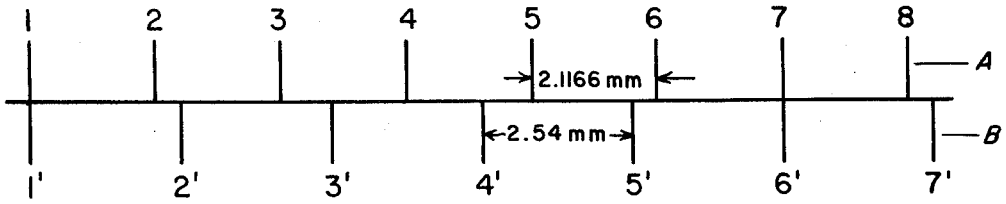
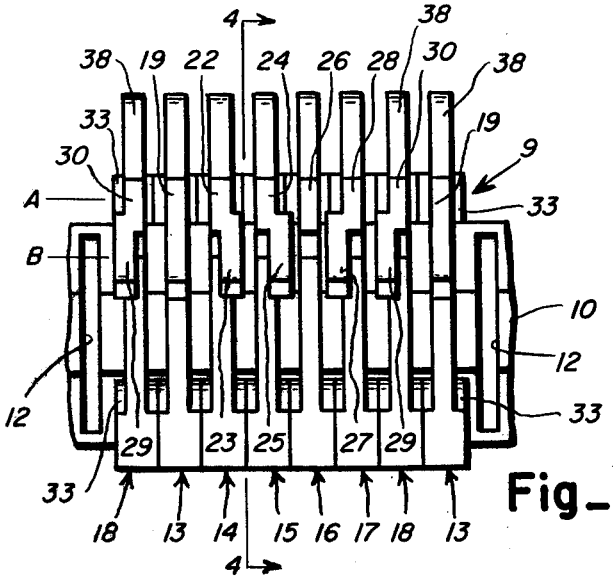
Fig_2
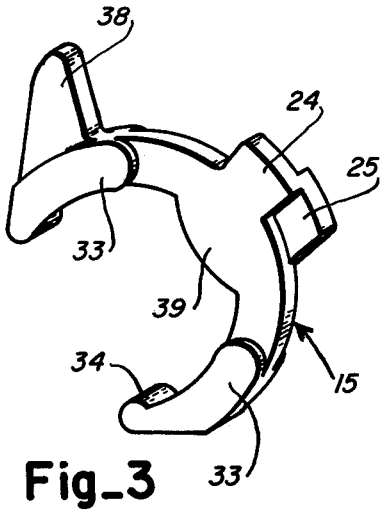
Fig_3
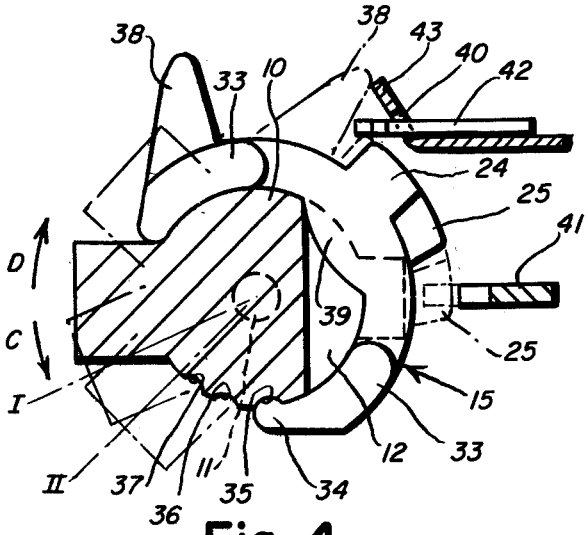
Fig_4
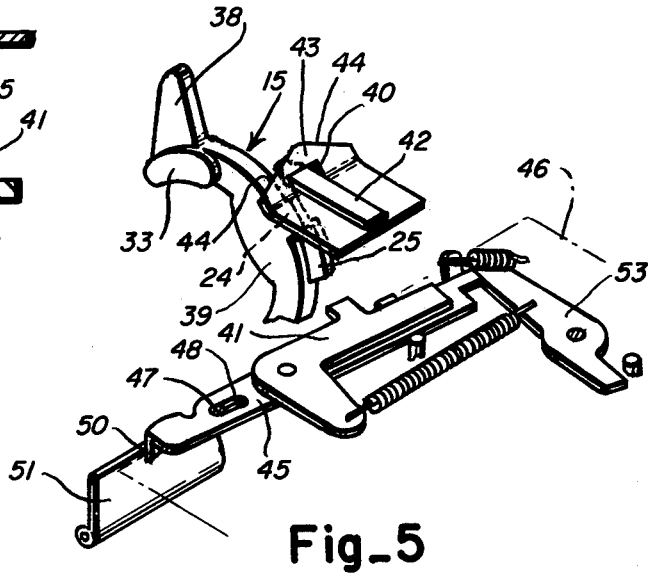
Fig_5

DUAL PITCH TABULAR STOP ASSEMBLY

This invention relates to tab stop assembly for use with typewriters or like machines having selectable pitch escapements; more particularly, it relates to a tab rack having multiple sets of uniformly spaced tab stops with each set corresponding to a selected escapement pitch; and specifically to a tab rack wherein individual stops of each set are formed on each of an array of tabs which are mounted for rotative movement on and relative to a tab rack to selected set positions corresponding to selected escapement pitches.

In U.S. Pat. No. 3,540,565, a tabular stop assembly for use with a typewriter having a dual pitch escapement is disclosed wherein tab stops are mounted at calculated non-uniform spacings such that, giving consideration to the engagement tolerance range of an escapement pawl, will enable sufficient time for an escapement pawl to engage the correct tooth on either escapement rack. Thus, a single array of tab stops is operative to provide accurate spacing regardless of which of the two escapement racks is selected for use. However, the manufacture of such a rack with non-uniformly spaced tab stops is expensive in that individual slots to accomodate the tab stops must be cut or milled at different spacings while maintaining close tolerances. Furthermore, such a type rack depends, for reliable operation, on the inherent delays attendant to relatively moving parts being maintained.

In accordance with this invention, a tabular stop assembly for use with a typewriter having dual pitch escapement is provided which is easier to manufacture and is reliable in operation. In accordance with the invention, a tabular stop assembly is provided with uniformly spaced slots to accommodate a plurality of C-shaped tabs. Tabs include one or two tab stops, one of which corresponds to a first array of uniformly spaced stops and the other of which corresponds to a second array of uniformly spaced stops of different pitch than the first array of stops with each array of stops corresponding to a selected escapement pitch. Each tab is mounted for rotative movement relative to the tab rack to position one or the other of its stops to set position according to the escapement pitch selected. Such a uniformly slotted tab rack can be designed in accordance with the teaching of German Design Patent No. 7,422,589.

Accordingly, an object of the invention is to provide a tab stop assembly for use in a typewriter having a dual pitch escapement which is easy to manufacture and is reliable in operation.

Another object of the invention is in the provision of a tabular stop assembly for a typewriter having a dual pitch escapement comprising a tab rack for mounting tabs at uniform spacings wherein each of a number of tabs include two circumferentially spaced tab stops, each of which is one of an array of uniformly spaced tab stops corresponding to different escapement pitches.

Still another object of the invention is in the provision of a tabular stop assembly having two sets of uniformly spaced tab stops wherein individual stops of each set are integrally formed on single moldable tabs formed to be mounted on a tab rack for movement relative thereto.

Other objects, features and advantages of the present invention will become apparent to those skilled in the art from a reading of the following detailed description of a preferred embodiment when taken in conjunction with the accompanying drawing wherein like reference numerals designate like or corresponding parts throughout the several views thereof and wherein:

FIG. 1 is a diagram illustrating the spacing of a 10 pitch (2.54mm) and a twelve pitch (2.1166mm) rack;

FIG. 2 is an elevational view of a tubular stop assembly having two arrays of tab stops in accordance with the invention with all stops rotated to unset positions;

FIG. 3 is a perspective view of a C-shaped tab;

FIG. 4 is a cross-sectional view taken along lines 4—4 of FIG. 2 with other elements of a tabular assembly showing the basic position of the tab rack relative thereto; and FIG. 5 is a perspective view of a tubular lever assembly which cooperates with the tabular stop assembly to set and reset stops and to effect the arrest of the typewriter carriage element at a set stop position.

Referring now to the drawing wherein like reference characters and numerals designate like or corresponding elements throughout the several views, there is illustrated in FIG. 1, on a 10 to 1 scale, an array A of rack tooth spacings 1–8 of a 12 pitch rack and an array B of rack tooth spacings 1′–7′ of a 10 pitch rack.

As shown, every seventh tooth of the 12 pitch rack array A will be aligned with every sixth tooth of the 10 pitch rack array B.

With reference to FIGS. 2, 3 and 4, to accommodate stops corresponding to all the different spacings between the 12 and 10 pitch rack arrays A and B, there is provided a tabular stop assembly generally designated by reference numeral 9 comprising a key hole shaped tab rack 10 which is suitably pivotally mounted at its ends as at 11 in a carriage or base frame according to whether it is accommodated in a movable platen or a movable printing element machine, respectively, as will be understood in the art. The rab rack 10 has guide slots 12 at 10 pitch intervals into which six different types of C-shaped tabs, generally designated by reference numerals 13–18, are arranged in repeating order and mounted as shown in FIG. 2 and 4. Tabs 13 have a radially outward extending projection 19 residing in the plane of the C-shaped tab 13 which extends over an arc such that it serves as a stop in both the 10 and 12 pitch rack arrays, e.g. positions 1–1′ of FIG. 1, respectively. Tabs 14 also have a radially outward extending projection which has an upper arcuate portion 22 which is in the plane of the body of the table 14, and a lower arcuate portion 23 of which is offset to the right as viewed in FIG. 2. Portion 22 constitutes a stop in the 12 pitch array A corresponding to positions 2 (FIG. 1) of the 12 pitch rack and portion 23, a stop in array B corresponding to position 2′. Tabs 15, also shown in FIG. 3, are formed similarly to tab 14 with a planar upper portion 24 and a lower portion 25 offset further to the right, the upper portion 24 constituting a stop in array A corresponding to position 3 and the lower offset portion 25 constituting a stop in array B corresponding to position 3′. Tabs 16 have a radially outward extending projection 26 residing in the plane of the body of tabs 16 which extends over a shorter arc and constitutes a stop only in array A corresponding to the 4 position. Accordingly, tab 16 presents no stop in the 10 pitch array B. Tabs 17 and 18 are similarly formed with radially outward extending projections with upper portions 28 and 30 and lower portions 27 and 29, respectively, which are suitably offset, however, to the left with the portions 28 and 30 of tabs 17 and 18 constituting stops in array A corresponding to positions 5 and 6 therein and portions 27, 29 of tabs 17 and 18 constituting the stops in array B corresponding to positions 4' and 5' therein, respectively.

Thus, with reference to FIG. 2, portions 19, 22, 24, 26, 28, 30 of tabs 13–18 constitute a series of uniformly spaced stops in a 12 pitch array A, and portions 19, 23, 25, 27, 29 of tabs 13, 14, 15, 17 and 18 constitute a series of uniformly spaced stops in a 10 pitch array B.

With reference to FIG. 3, each C-shaped tab is wider at its ends 33 so that when mounted they provide lateral support to one another. Further, the lower terminal part of each C-shaped tab has a rounded projection 34 in its inner side which is provided to detentably engage corresponding snap-in grooves 35, 36, 37 formed in the tab rack 10 when the C-shaped tabs are snap mounted thereon. Further, each tab, near its upper terminal end, has an outward projection 38 which serves, as will hereinafter appear, as a reset finger. The tabs 13–18 may be molded in one piece from suitable plastic and further formed with a rounded inner shape 39 to provide better guidance in the slots 12 of the tab rack 10.

With reference to FIG. 4, the tab rack 10 is shown in basic operating position with tabs in reset positions (full line) corresponding to the showing in FIG. 2. In basic position, with no tab in a set position, no stop will be positioned to engage a tabular lever 41 which is movable to the dotted line position illustrated in FIG. 4 incident to calling a tabulating function.

In order to set a tab, the tab rack 10 must be turned in direction of arrow C. Assuming that tab 15 is at the printing position and rack 10 is rotated from its basic position to dotted line position I, the stop 24 of tab 15 will strike the end of a setting lever 42 so that the tab 15 will be turned out of its reset position relative to the tab rack 10 far enough for the snap-in projection 34 to jump out of the snap-in groove 35 and into the snap-in groove 36. After the conclusion of the setting of tab 15, the tab rack 10 will be returned to the basic position shown, but stop 25 of tab 15 will now be positioned as shown in dotted lines whereat in the event of a tabulation, the tabulator lever 41 would encounter the stop 25 of array B. If array A stops are to be set, the tab rack 10 is turned further in direction of arrow C to the dotted line position II. This will cause the tab 15 to turn relative to the tab rack 10 far enough for its snap-in projection 34 to engage the snap-in groove 37 placing stop 24 of array A in position to encounter the path of tabulator stop lever 41 when, after the conclusion of the setting operation, the tab rack 10 is returned to its basic portion shown in full lines in FIG. 4. Similarly, other stops in array A or B are moved to set postions.

To cancel single or several set tabs, the tab rack 10 is turned in direction of arrow D sufficiently to bring cancel finger 38 against a cancel lever 43, causing the tab 15 to return to its full line reset position with its snap-in projection 34 again engaged in the snap-in groove 35. The cancel lever 43, as may be seen from FIG. 5, is triangular of roof-shaped and that its two bevel surfaces 44 can act to cam set tabs back into their reset positions in the event of a relative motion between the cancel fingers 38 and the cancel lever 43. As shown in FIG. 5, the setting lever 42 extends through a slot 40 of the cancel lever 43.

As shown in FIG. 5, the tabulator stop lever 41 is pivotally mounted on a rocking lever 45 which is also movable longitudinally relative to a base plate 46 guided by means of a pin 47 on the base plate 46 extending into an elongated hole 48 in the rocking lever 45. In a tabulating operation, the rocking lever 45 is rocked by means of a projection 50 thereon located in the path of a pivoting bail 51 thereby carrying the tabulator lever 41 to the dotted line position shown in FIG. 4 to encounter set stops. A locking lever 53 latches the rocking lever 45 and the tabulator lever 41 in operating position until, during a relative motion between the tabs and the tabulator lever 41, the latter encounters a set stop, for example stop 25 of tab 15. The consequence thereof is that the rocking lever 45 is shifted to the left as viewed in FIG. 5 to the extent permitted by elongated hole 48 and is thereby released from the locking lever 53 and the parts 41, 45 and 53 resume the position shown in FIG. 5.

It is obvious from the drawing that the tab rack 10 can be produced very simply due to the uniform spacings of the slots 12 in it. The tabs 13–18 need merely be clipped to the tab rack 10 and they will stay on it due to their own clamping ability. To make their placement on the rack 10 easier, they may be of different colors, as they must be arranged in the sequence shown. Since such color coding determines the sequence of the various tabs, it is also easier to check them over.

What is claimed is:

1. Tabulating mechanism for use with dual pitch escapements comprising a tab rack, a plurality of tabs all of which are rotatably detentably mounted and spaced at uniform intervals on said tab rack, each of said tabs having a first surface in the plane of the tab defining a tab stop in a first repeating series of uniformly spaced tab stops, each of said tabs less one having a second surface angularly immediately adjacent said first surfaces on said tabs defining a tab stop in a second repeating series of uniformly spaced tab stops of greater spacing than the spacing of said first series of tab stops, the initial one of said first and second surfaces in each series being in the same plane with the following second surfaces being offset from the plane of said tabs differing amounts to define said second repeating series of uniformly spaced tab stops, a tab setting abutment, and a tabular blade positionable to encounter stop surfaces of set tabs, said tab rack being rotatable from a home position in a setting direction to bring said tabs into contact with said setting abutment to move said tabs relative to said rack therby to position stops in said first or second series for encounter with said tabular blade upon restoration of said tab rack to its home position.

2. Tabulating mechanism as recited in claim 1, said tabs being C-shaped to detentably embrace said tab rack.

3. Tabulating mechanism as recited in claim 1, including a tab cancelling abutment, said tab rack being rotatable in a resetting direction, and means on said tabs for encountering said tab cancelling abutment to thereby reset tabs incident to rotation of said tab rack in resetting direction.

* * * * *